United States Patent [19]

Benedict

[11] 4,236,634

[45] Dec. 2, 1980

[54] GARMENT STORAGE BAG

[76] Inventor: Gertrude B. Benedict, 2546 Edison, Detroit, Mich. 48206

[21] Appl. No.: 12,844

[22] Filed: Feb. 16, 1979

[51] Int. Cl.[3] ..... B65D 85/18

[52] U.S. Cl. ..... 206/287; 206/289; 190/41 B; 190/42; 220/23.4

[58] Field of Search ..... 206/286, 287, 289, 290, 206/292, 293, 294, 295, 296, 298; 190/41 B, 42; 220/23-24

[56] References Cited

U.S. PATENT DOCUMENTS

| | | | |
|---|---|---|---|
| 1,218,831 | 3/1917 | Boch | 206/286 X |
| 1,454,334 | 5/1923 | Parker | 206/287 X |
| 2,351,882 | 6/1944 | Schwartzman | 206/287 |
| 3,628,790 | 12/1971 | Gordon | 220/23.4 |
| 3,746,151 | 7/1973 | Brophy et al. | 206/287 |

FOREIGN PATENT DOCUMENTS

| | | | |
|---|---|---|---|
| 436800 | 10/1935 | United Kingdom | 206/286 |

*Primary Examiner*—Joseph Man-Fu Moy

*Attorney, Agent, or Firm*—Weintraub & Hanlon Basile

[57] ABSTRACT

A garment storage sectional container for storing garments on a longitudinally extending support pole in a dust proof manner is disclosed. The garment storage container or bag comprises a frame for supporting a top member of the bag above the pole, a sectional structure for enclosing the garments joinable at its end to an end closure member, an adapter member, or an adjacent bag. A plurality of sectional structure can be joined together along the length of a support pole using slide fasteners where they are joined. Bags or sectional structures of different lengths can be joined using an adapter section with a bottom member which extends at an angle from the bottom of a shorter bag to the bottom of a longer bag.

8 Claims, 5 Drawing Figures

GARMENT STORAGE BAG

BACKGROUND OF THE INVENTION

I. Field of the Invention

The present invention relates to the field of garment storage bags of rectangular cross-section having a wire frame at the top for support. The present invention relates particularly to the field of garment storage bags having slide fastener closures for dust proof storage of the garments stored therein. More particularly the present invention relates to the field of garment storage bags that are joinable one to another along a longitudinally support pole using slide fasteners.

II. Prior Art Statement

Garment storage bags of a rectangular cross-section having a wire frame at their top to support a plastic bag and a slide fastener enclosure for closing the bag have long been known in the art. U.S. Pat. Nos. 1,290,299; 2,481,102; and 2,534,380 are illustrative of this type of garment storage bag. None of the above listed U.S. Patents disclose a garment storage bag of rectangular cross-section with its top wall supported above the longitudinal support rod. Furthermore, none of the above listed U.S. Patents disclose a garment storage bag wherein a plurality of bags are joined one to another along a support pole, the bags being joined by slide fasteners. The above listed U.S. Patents constitute the entire prior art relating to the present invention that is known to the Applicant and her Attorney.

SUMMARY OF THE INVENTION

The present invention comprises a garment storage bag for storing sectional structure or garments along a longitudinally extending support pole. The storage bag comprises a frame means for positioning a top member of the bag above the support pole; the bag or sectional structure joinable at its end to an end closure member, an adapter member, or another bag. The bag is joined to the top member by a strip of releasable friction fabric which is commercially available under the trade name of "Velcro".

The frame comprises a pair of wires disposed at either end of the top member having a straight top, a pair of legs extending downward and inward to the support pole, the leg ends curving upward and inward in an arcuate manner to form a semi-circle which surrounds an upper portion of the rod.

An end closure is provided which has a form complimentary to the top member and a lower bag or sectional structure when the top member and lower bag are joined together. A releasable slide fastener along the periphery of the end closure and the periphery of the top member and lower bag joins the end closure to the bag. An opening extends downward from the top of the end closure at its center to the rod, and a slide fastener along the opening allows the opening to be closed after the end closure has been fitted around the rod.

Garment storage sectional structures or bags of varying length can be joined together using an adapter section which comprises an adapter top member having a top wall and a pair of downward extending adapter upper side walls integral with the top wall. A releasable friction engaging fabric is disposed along the bottom edge of the adapter upper side walls. A releasable slide fastener is disposed along the edges of the adapter upper side walls and the adapter top wall. An adapter lower bag has a pair of adapter side walls having a length along one edge complimentary to the length of a first adjacent lower bag, and a length along other edge complimentary to the length of a second adjacent lower bag. A releasable friction engaging fabric is disposed along the top edge of each adapter side wall, and a bottom wall integral with the adapter side walls extends between side walls at an angle from the first adjacent lower bag to the second adjacent lower bag. A slide fastener along the edges of the adapter side walls adjacent the first and second lower bags and along the bottom wall adjacent the first and second lower bags joins the adjacent bags to the adapter section.

To use the garment storage bag of the present invention in closets having a channel for supporting clothes hangers rather than a rod, a rod support and rod is used comprising a pair of spaced apart supports having a hook at their upper end to engage the channel and a loop at their lower end spaced below the channel. A rod engages the loops at its ends and is supported therebetween.

Other objects, advantages, and applications of the present invention will become apparent to those skilled in the art to which the present invention pertains when the accompanying description of one example of the best mode contemplated for practicing the invention is read in conjunction with the accompanying drawing.

BRIEF DESCRIPTION OF THE DRAWINGS

The description herein makes reference to the accompanying drawings wherein like reference numbers refer to like parts throughout the several views, and wherein.

DESCRIPTION OF THE PREFERRED EMBODIMENT

Figure 4:
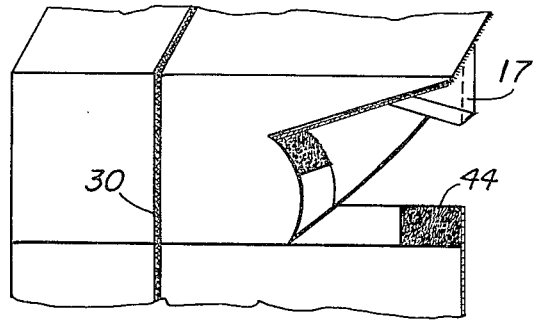
FIG. 4 illustrates an enlarged broken perspective view of the top member.
Figure 1:
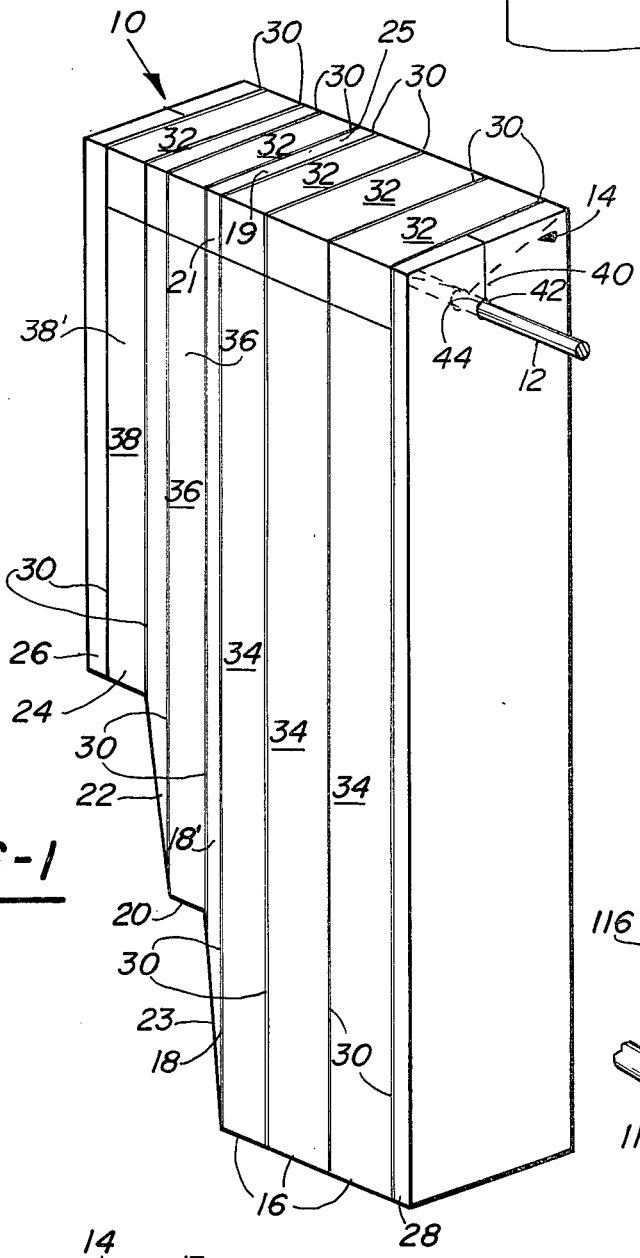
FIG. 1 illustrates a perspective view of the preferred embodiment of the present invention.
Figure 2:
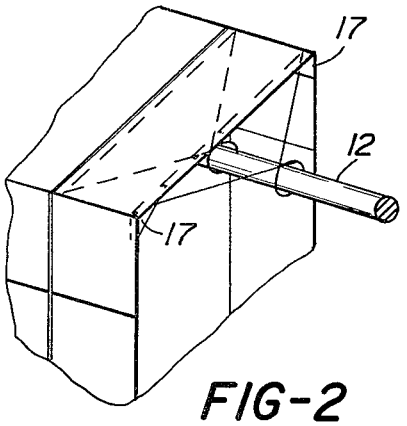
FIG. 2 illustrates a perspective view of the frame for supporting the bag.
Figure 3:
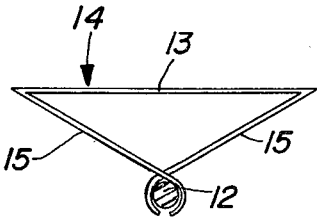
FIG. 3 illustrates an end view of the frame.

Referring now to the drawings and in particular to FIGS. 1–5 wherein there is illustrated at 10 a preferred embodiment of the present invention comprising a support rod 12 a plurality of frame means 14, a plurality of long sectional containers or bags 16, a long adapter section 18 an intermediate section or bag 20, an intermediate adapter section 22, a short section or bag 24 a short end closure 26 and a long end closure 28. The sections bags or adapter section, and end closure are joined in open communication one to another using slide fastener means 30 of an appropriate size. It is readily apparent that the number of garment storage sectional containers or bags that can be stored or assembled on a pole 12 is limited only by the length of the pole.

Each garment storage bag or section is supported above the pole 12 by a pair of frame means comprising a wire having a straight top 13 a pair of legs 15 extending downward and inward to the support pole, the leg ends curving upward and inward in an arcuate manner to form a semi-circle surrounding an upper portion of the rod 12. A pair of pockets 17 retain the ends of the frame 14 in position in a manner which will be described subsequently.

Each bag or sectional structure comprises a top member 32 and a lower bag or section member 34,36, or 38 depending on the length of the structure or bag. The top member comprises a top wall, a pair of downward extending side walls integral with the top wall, a releasable friction engaging fabric such as "Velcro" along the loer edge of the upper side wall, and a releasable slide fastener along the ends of the upper side walls and the top wall. The pair of pockets 17 comprise a pair of spaced walls extending across an intersection of the top wall and upper side wall to engage outer ends of the frame 14 holding the frame in position. The lower bag comprises a pair of side walls 34', 36', or 38' (depending upon length) each pair of side walls is integral with a bottom wall (not shown). A releasable friction engaging fabric of "Velcro" is disposed along the upper edge of the side walls to join the lower section to the top member. A releasable slide fastener 30 is disposed along the ends of the side walls and the bottom walls to join the lower sections one to another, or to an adapter section, or to an end closure. To accommodate sectional structures of varying length the adapter section 18 is used to provide a transition from a section of intermediate length to a sectional structure of long length; and an adapter section 22 is used to accommodate the transition of a sectional structure of small length to a section of intermediate length. The adapter sections 18 and 22 are identical in construction and function and vary only in length to accommodate the joining of different size sectional structures. To promote brevity, only adapter section 18 will be described in detail hereinbelow but it is to be understood that the adapter sections differ only in size.

The adapter section 18 comprises an adapter top member 25 having an adapter top wall 19, a pair of downward extending adapter upper side walls 21 integral with the top wall 19, a "Velcro" fastener along the bottom edge of the adapter upper side walls, and a releasable slide fastener along the edges of the adapter upper side walls and the adapter top wall to engage adjacent top members 32. Also included in the adapter section is an adapter lower section comprising a pair of adapter side walls 18 releasably engageable with adjacent bags, having a length along one edge complimentary to the length of a first adjacent lower section 20 and the length along another edge complimentary to the length of a second adjacent lower section 16. A releasable friction engaging fabric of "Velcro" along a top edge of each adapter side wall 18' attaches the side wall 18' to the adapter upper side walls 21. A bottom wall 23 integral with the adapter side walls 18' extends at an angle from the first adjacent lower section to the second adjacent lower section, and a slide fastener 30 along the edges of the adapter side walls adjacent the first and second lower sections and along the bottom wall adjacent the first and second lower bag bottom walls attaches the adapter section to the first and second adjacent sections.

The end closure 28 has a shape complimentary to the assembled shape of the lower section 34 and the top member 32. A slide fastener 30 around the perimeter of the end closure 28 permits the end closure 28 to be joined to a garment sectional container assembly at its end to enclose the container. An opening 40 extends from the center of the top of the end closure 28 to the rod 12. The opening 40 has an enlarged opening 42 to surround the rod, and a "Velcro" fastener 44 allows the opening 40 to be closed around the rod 12. The end closures 26 and 28 are identical in construction and function, varying only in the length of garment section they accommodate. To promote brevity, only the garment section closure 28 will be discussed herein.

Figure 5:
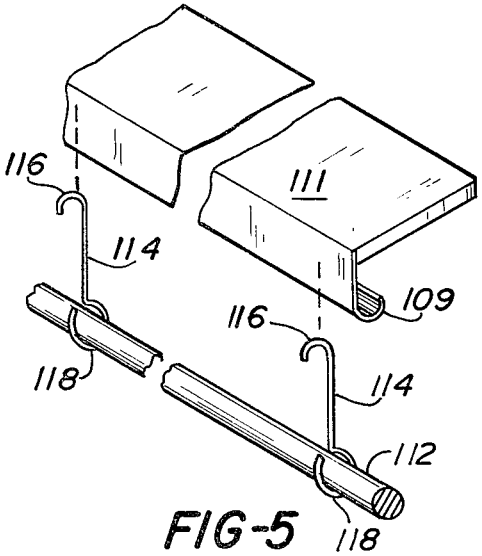
FIG. 5 illustrates a perspective view of a rod for supporting garments in storage areas having a channel for supporting garment hangers.

Some enclosures for storing garments such as clothes closets do not have a longitudinal rod for accommodating clothes hangers (FIG. 5). They have, instead, a longitudinal channel 109 along the edge of a shelf 111 to which clothes hangers are hooked. In this case there is no longitudinal rod to which the garment storage bag can be attached. To accommodate the invention in storage areas having a channel for supporting garment hangers, a rod 112 is supported longitudinally between a pair of spaced apart supports 114 having a hook 116 at their upper end to engage the channel and a loop 118 at their lower end spaced below the channel. Once the rod and its support are in place the invention can be employed as described hereinabove.

The invention as described hereinabove provides an inexpensive flexible and convenient means for storing garments. Since the support rod 12 is spaced below the top member 32 opening of the slide fastener 30 permits any number of garments to be easily supported on the support rod 12 using conventional garment hangers. Once the garments are in place the slide fastener 30 is reclosed, a dust proof storage bag is provided.

Having thus described my invention what I claim is:

1. A garment storage sectional container including a plurality of sectional structures of varying length in open communication with each other supported by a longitudinally extending support rod, comprising:

a frame means for supporting the sectional structures above the support rod;

said sectional structure further comprising a plurality of top members open at their ends supported by the frame means; and said structure further comprising a plurality of lower sections open at their ends supported by the top members.

2. The garment storage sectional container as defined in claim 1 wherein said frame means comprises a pair of wires supporting each top member having a straight top, a pair of legs extending downward and inward to the support pole, the leg ends curving upward and inward in an arcuate manner to form a pair of semi-circles surrounding an upper portion of the support rod.

3. The garment storage sectional container as defined in claim 1 wherein the sectional structure further comprises the top member and lower section having a slide fastener along their edges to releasably engage an adjacent section, wherein the adjacent member may comprise an end closure member, an adapter member and another bag.

4. The garment storage sectional container of claim 3 wherein the top member comprises:

a top wall;

a pair of downward extending upper side walls integral with the top wall;

a releasable friction engaging fabric along a lower edge of the upper side wall; and a releasable slide fastener along the edges of the upper side walls and the top wall to releasably join the top member to an adjacent top member.

5. The garment storage sectional container as defined in claim 3 wherein the lower section comprises:

a pair of side walls integral with a bottom wall and joinable to the top member;

a releasable friction engaging fabric along the upper ends of the side walls to releasably join the lower section to the top member; and a releasable slide fastener along the edges of the side walls and bottom walls to releasably join the lower section to an adjacent lower section.

6. The garment storage sectional container of claim 3 further comprising:

an end closure having a form complementary to the top member and lower section when joined together;

a releasable slide fastener along the periphery of the end closure mating with the slide fastener of the top member and lower section;

an opening extending downward from the top of the end closure at its center to the rod, the opening enlarged at its end to encircle the rod; and a "Velcro" fastener along the opening extending from the top of the enclosure to the support rod.

7. The garment storage sectional container of claim 5 wherein the lower section has varying length.

8. The garment storage sectional container of claim 7 further comprising an adapter section to provide transition from a lower section of one length to a lower section of a different length, said adapter comprising:

an adapter top member comprising an adapter top wall, a pair of downward extending adapter upper side walls integral with the top wall, a releasable friction engaging fabric along the bottom edge of the adapter upper side walls, and a releasable slide fastener along the edges of the adapter upper sidewalls and the adapter top wall to releasably join the adapter top member to an adjacent top member;

an adapter lower bag with a pair of adapter side walls having a length along one edge complementary to the length of a first adjacent lower section, and a length along another edge complementary to the length of a second adjacent lower section, a releasable friction engaging fabric along a top edge of each adapter side wall, to releasably join the adapter lower section to the adapter top member, an adapter bottom wall integral with the adapter side walls extending from the first adjacent lower section bottom wall to the second adjacent lower bottom wall, a slide fastener along the edges of the adapter side walls adjacent the first and second lower adapter and along the adapter bottom wall edges adjacent the first and second lower section bottom wall edges to releasably join the adapter lower section to the first and second lower sections.

* * * * *